US007092800B2

(12) United States Patent
Kane et al.

(10) Patent No.: US 7,092,800 B2
(45) **Date of Patent: *Aug. 15, 2006**

(54) LIFTING RESTRICTIVE SIGNALING IN A BLOCK

(75) Inventors: Mark Edward Kane, Orange Park, FL (US); James Francis Shockley, Orange Park, FL (US); Harrison Thomas Hickenlooper, Palatka, FL (US)

(73) Assignee: Quantum Engineering, Inc., Orange Park, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/032,053

(22) Filed: Jan. 11, 2005

(65) Prior Publication Data

US 2005/0159860 A1 Jul. 21, 2005

(51) Int. Cl.
*G05D 1/00* (2006.01)
*G06F 7/00* (2006.01)

(52) U.S. Cl. ..... 701/19; 701/20

(58) Field of Classification Search ..... 701/19–20; 246/182 R, 5, 187 B; 340/991, 993, 988
See application file for complete search history.

(56) References Cited

U.S. PATENT DOCUMENTS 4,181,943 A 1/1980 Mercer, Sr. et al.
4,459,668 A 7/1984 Inoue et al.
4,561,057 A 12/1985 Haley, Jr. et al.
4,711,418 A 12/1987 Aver, Jr. et al.
5,072,900 A 12/1991 Malon
5,129,605 A 7/1992 Burns et al.
5,177,685 A 1/1993 Davis et al.
5,332,180 A 7/1994 Peterson et al.
5,340,062 A 8/1994 Heggestad
5,364,047 A 11/1994 Petit et al.
5,394,333 A 2/1995 Kao
5,398,894 A 3/1995 Pascoe
5,452,870 A 9/1995 Heggestad
5,533,695 A 7/1996 Heggestad et al.
5,620,155 A 4/1997 Michalek
5,699,986 A 12/1997 Welk
5,740,547 A 4/1998 Kull et al.
5,751,569 A 5/1998 Metel et al.

(Continued)

OTHER PUBLICATIONS

"Testimony of Jolene M. Molitoris, Federal Railroad Administrator, U.S. Department of Transportation before the House Committee on Transportation and Infrastructure Subcommittee on Railroads", Federal Railroad Administration, United States Department of Transportation, Apr. 1, 1998.

(Continued)

*Primary Examiner*—Yonel Beaulieu
(74) *Attorney, Agent, or Firm*—DLA Piper Rudnick Gray Cary US LLP

(57) ABSTRACT

A train control system and method uses signal information from a next block to change a restrictive signal in a block currently occupied by the train to a less restrictive signal if it can be ascertained that the condition causing the more restrictive signal has changed. This may be accomplished by receiving signal information from the next block while still in the current block and, if the signal information from the next block is no more restrictive than the signal information in the current block, and the signal in the current block is of a type that can safely be modified, allowing the train to operate as if the signal information for the current block were less restrictive than the actual, previously received signal information for the current block.

18 Claims, 3 Drawing Sheets

U.S. PATENT DOCUMENTS

| | | | |
|---|---|---|---|
| 5,803,411 | A | 9/1998 | Ackerman et al. |
| 5,828,979 | A | 10/1998 | Polivka et al. |
| 5,867,122 | A | 2/1999 | Zahm et al. |
| 5,944,768 | A | 8/1999 | Ito et al. |
| 5,950,966 | A | 9/1999 | Hungate et al. |
| 5,978,718 | A | 11/1999 | Kull |
| 5,995,881 | A | 11/1999 | Kull |
| 6,049,745 | A | 4/2000 | Douglas et al. |
| 6,081,769 | A | 6/2000 | Curtis |
| 6,102,340 | A | 8/2000 | Peek et al. |
| 6,112,142 | A | 8/2000 | Shockley et al. |
| 6,135,396 | A | 10/2000 | Whitfield et al. |
| 6,179,252 | B1 | 1/2001 | Roop et al. |
| 6,218,961 | B1 | 4/2001 | Gross et al. |
| 6,311,109 | B1 | 10/2001 | Hawthorne et al. |
| 6,322,025 | B1 | 11/2001 | Colbert et al. |
| 6,345,233 | B1 | 2/2002 | Erick |
| 6,371,416 | B1 | 4/2002 | Hawthorne |
| 6,373,403 | B1 | 4/2002 | Korver et al. |
| 6,374,184 | B1 | 4/2002 | Zahm et al. |
| 6,377,877 | B1 | 4/2002 | Doner |
| 6,397,147 | B1 | 5/2002 | Whitehead |
| 6,421,587 | B1 | 7/2002 | Diana et al. |
| 6,456,937 | B1 | 9/2002 | Doner et al. |
| 6,459,964 | B1 | 10/2002 | Vu et al. |
| 6,459,965 | B1 | 10/2002 | Polivka et al. |
| 6,487,478 | B1 | 11/2002 | Azzaro et al. |
| 6,609,049 | B1 | 8/2003 | Kane et al. |
| 6,701,228 | B1 | 3/2004 | Kane et al. |
| 6,824,110 | B1 | 11/2004 | Kane et al. |
| 6,845,953 | B1 | 1/2005 | Kane et al. |
| 6,853,888 | B1 | 2/2005 | Kane et al. |
| 6,863,246 | B1 | 3/2005 | Kane et al. |
| 6,865,454 | B1 | 3/2005 | Kane et al. |
| 2001/0056544 | A1 | 12/2001 | Walker |
| 2002/0070879 | A1 | 6/2002 | Gazit et al. |

OTHER PUBLICATIONS

"System Architecture, ATCS Specification 100", May 1995, no specific date.
"A New World for Communications & Signaling", Progressive Railroading, May 1986, no specific date.
"Advanced Train Control Gain Momentum", Progressive Railroading, Mar. 1986, no specific date.
"Railroads Take High Tech in Stride", Progressive Railroading, May 1985, no specific date.
Lyle, Denise, "Positive Train Control on CSXT", Railway Fuel and Operating Officers Association, Annual Proceedings, 2000, no specific date.
Lindsey, Ron A., "C B T M, Communications Based Train Management", Railway Fuel and Operating Officers Association, Annual Proceedings, 1999, no specific date.
Moody, Howard G, "Advanced Train Control Systems A System to Manage Railroad Operations", Railway Fuel and Operating Officers Association, Annual Proceedings, 1993, no specific date.
Ruegg, G.A., "Advanced Train Control Systems ATCS", Railway Fuel and Operating Officers Association, Annual Proceedings, 1986, no specifc date.
Malone, Frank, "The Gaps Start to Close"Progressive Railroading, May 1987, no speicfic date.
"On the Threshold of ATCS", Progressive Railroading, Dec. 1987, no specific date.
"CP Advances in Train Control", Progressive Railroading, Sep. 1987, no specific date.
"Communications/Signaling: Vital for dramatic railroad advances", Progressive Railroading, May 1988, no specific date.
"ATCS's System Engineer", Progressive Railroading, Jul. 1988, no specific date.
"The Electronic Railroad Emerges", Progressive Railroading, May 1989, no specific date.
"$C^3$ Comes to the Railroads", Progressive Railroading, Sep. 1989, no specific date.
"ATCS on Verge of Implementation", Progressive Railroading, Dec. 1989, no specific date.
"ATCS Evolving on Railroads", Progressive Railroading, Dec. 1992, no specific date.
"High Tech Advances Keep Railroads Rolling", Progressive Railroading, May 1994, no specific date.
"FRA Promotes Technology to Avoid Train-To-Train Collisions", Progressive Railroading, Aug. 1994, no specific date.
"ATCS Moving slowly but Steadily from Lab for Field", Progressive Railroading, Dec. 1994, no specific date.
Judge, T., "Electronic Advances Keeping Railroads Rolling", Progressive Railroading, Jun. 1995, no specific date.
"Electronic Advances Improve How Railroads Manage", Progressive Railroading, Dec. 1995, no specific date.
Judge, T., "BNSF/UP PTS Pilot Advances in Northwest", Progressive Railroading, May 1996, no specific date.
Foran, P., "Train Control Quandary, Is CBTC viable? Railroads, Suppliers Hope Pilot Projects Provide Clues", Progressive Railroading, Jun. 1997, no specific date.
"PTS Would've Prevented Silver Spring Crash: NTSB", Progressive Railroading, Jul. 1997, no specific date.
Foran, P., "A 'Positive' Answer to the Interoperability Call", Progressive Railroading, Sep. 1997, no specific date.
Foran, P., "How Safe is Safe Enough?", Progressive Railroading, Oct. 1997, no specific date.
Foran, P., "A Controlling Interest In Interoperability", Progressive Railroading, Apr. 1998, no specific date.
Derocher, Robert J., "Transit Projects Setting Pace for Train Control", Progressive Railroading, Jun. 1998, no specific date.
Kube, K., "Variations on a Theme", Progressive Railroading, Dec. 2001, no specific date.
Kube, K., "Innovation in Inches", Progressive Railroading, Feb. 2002, no specific date.
Vantuono, W., "New York Leads a Revolution", Railway Age, Sep. 1996, no specific date.
Vantuono, W., "Do you know where your train is?", Railway Age, Feb. 1996, no specific date.
Gallamore, R., "The Curtain Rises on the Next Generation", Railway Age, Jul. 1998, no specific date.
Burke, J., "How R&D is Shaping the 21st Century Railroad", Railway Age, Aug. 1998, no specific date.
Vantuono, W., "CBTC: A Maturing Technology", Third International Conference On Communications Based Train Control, Railway Age, Jun. 1999, no specific date.
Sullivan, T., "PTC—Is FRA Pushing Too Hard?", Railway Age, Aug. 1999, no specific date.
Sullivan, T., "PTC: A Maturing Technology", Railway Age, Apr. 2000, no specific date.
Moore, W., "How CBTC Can Increase Capacity", Railway Age, Apr. 2001, no specific date.
Vantuono, W., "CBTC: The Jury is Still Out", Railway Age, Jun. 2001, no specific date.

Vantuono, W., "New-tech Train Control Takes Off", Railway Age, May 2002, no specific date.
Union Switch & Signal Intermittent Cab Signal, Bulletin 53, 1998, no specific date.
GE Harris Product Sheet: "Advanced Systems for Optimizing Rail Performance" and "Advanced Products for Optimizing train Performance", undated.
GE Harris Product Sheet: "Advanced, Satellite-Based Warning System Enhances Operating Safety", undated.
Furman, E., et al., "Keeping Track of RF", GPS World, Feb. 2001, no specific date.
Department of Transportation Federal Railroad Administration, Federal Register, vol. 66, No. 155, pp. 42352-42396, Aug. 10, 2001.

LIFTING RESTRICTIVE SIGNALING IN A BLOCK

BACKGROUND OF THE INVENTION

1. Field of the Invention

The invention relates to railroads generally, and more particularly to signal compliance train control methods and systems.

2. Discussion of the Background

Many methods for controlling trains are known. Such methods include the Automated Block Signaling (ABS) and Centralized Train Control (CTC) methods. In such methods, train tracks are divided into sections, referred to in the art as blocks, and an operator is relied upon to move a train in compliance with wayside signals that are positioned some distance before a block boundary. In traditional ABS and CTC systems and the like, the wayside signals comprise colored lights that are visually observed by the operator. In more modern variants of these systems, sometimes generically referred to as communication-based train control (CBTC) systems, the signal information is transmitted into the cab of a locomotive. Examples of such systems include cab signaling systems and the TRAIN SENTINEL™ system available from the assignee of the present application, Quantum Engineering, Inc. Some of these systems, including the TRAIN SENTINEL™ system, ensure operator compliance with signal information transmitted into the cab.

Such block-oriented systems vary in their implementation. However, one aspect shared by several of these systems is that a restrictive signal in one block may be caused by conditions in the next block. A problem shared by such known systems is that there is no provision for lifting the restrictive signal in a block if conditions in the next block causing the restrictive signal "clear up." Causing a train to operate under a restrictive signal unnecessarily makes operation of the train less efficient, which increases costs.

What is needed is a method and apparatus that allows the lifting of a restrictive signal after a block has been entered when such restrictive signal is no longer necessary, and that allows a less restrictive signal to be recognized even after a train has passed the aforementioned wayside signal device.

SUMMARY OF THE INVENTION

The present invention meets the aforementioned need to a great extent by providing a computerized train control system that uses signal information from a next block to change a restrictive signal in a block currently occupied by the train to a less restrictive signal if it can be ascertained that the condition causing the more restrictive signal has changed. This may be accomplished by receiving signal information from the next block while still in the current block and, if the signal information from the next block is no more restrictive than the signal information in the current block and if the signal for the current block is of a type that can safely be modified, allowing the train to operate as if the signal information for the current block were less restrictive than the actual, previously received signal information for the current block. In preferred embodiments of the invention, wayside signal devices transmit messages including signal information and identification information in order to allow the system to unambiguously determine that the signal information in the message corresponds to the next wayside signal device.

BRIEF DESCRIPTION OF THE DRAWINGS

A more complete appreciation of the invention and many of the attendant features and advantages thereof will be readily obtained as the same become better understood by reference to the following detailed description when considered in connection with the accompanying drawings, wherein.

DETAILED DESCRIPTION

The present invention will be discussed with reference to preferred embodiments of train control systems. Specific details, such as types of signaling systems, are set forth in order to provide a thorough understanding of the present invention. The preferred embodiments discussed herein should not be understood to limit the invention. Furthermore, for ease of understanding, certain method steps are delineated as separate steps; however, these steps should not be construed as necessarily distinct nor order dependent in their performance.

Figure 1:
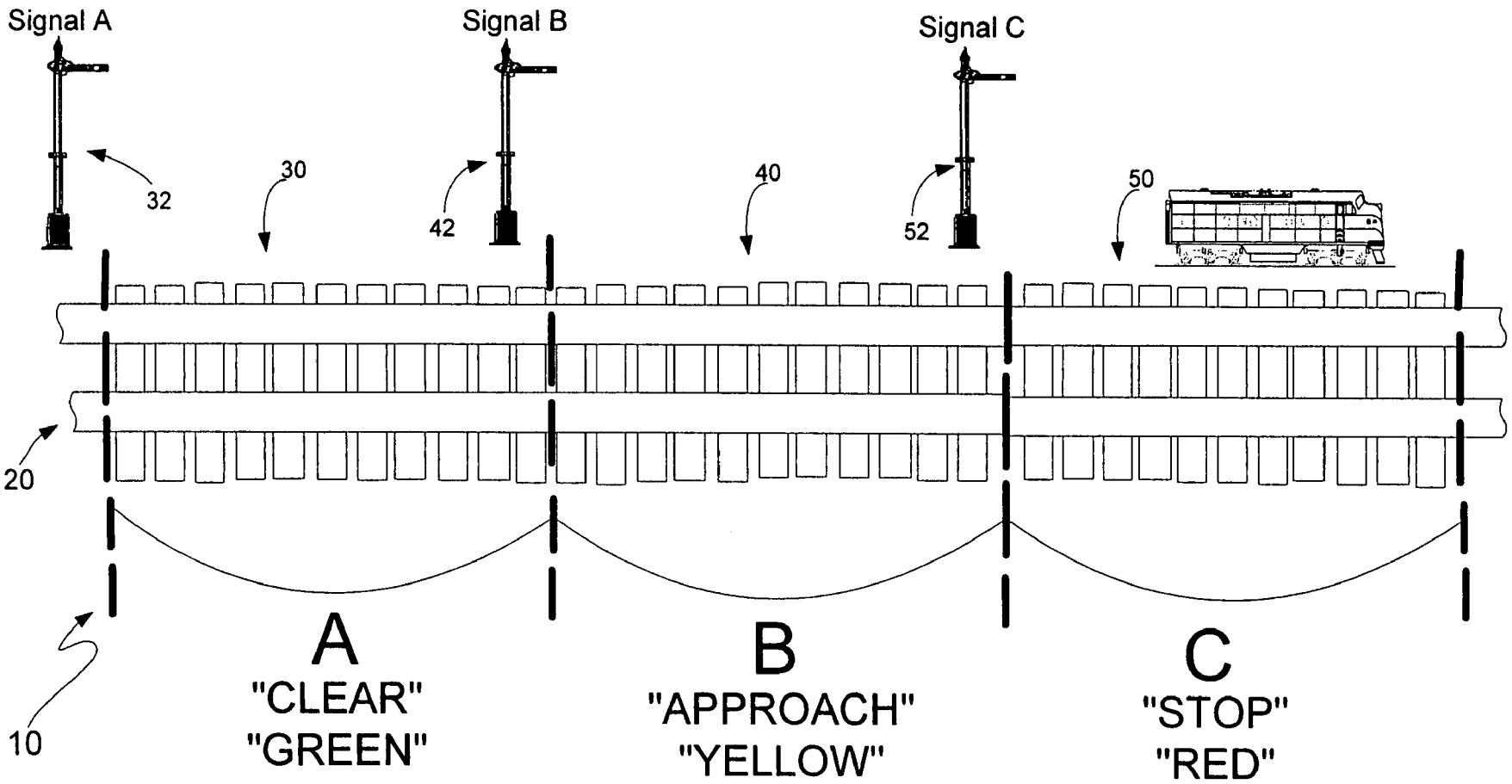
FIG. 1 is a schematic diagram showing a portion of train track divided into a plurality of blocks according to one known signaling method.

Referring now to the drawings, wherein like reference numerals designate identical or corresponding parts throughout the several views, FIG. 1 illustrates a traditional ABS system 10 in which a train track 20 that has been divided into three blocks 30, 40, 50 labeled "A," "B" and "C," respectively. A wayside signal 32, 42 and 52 is associated with each of the blocks 20, 40 and 50. The wayside signals 32, 42, 52 include colored lights to provide visual signal information to operators on trains approaching the signals. The signal 52 for block C 50 will be red if a train 60 is in block C 50 or if a broken rail has been detected in block C 50. A red signal means stop before entering the block.

When the signal 52 in block C 50 is red, the signal 42 in block B 40 is yellow, which signifies that speed should be reduced in preparation for stopping prior to entering the next block C 50. The signal 32 in block A 30 will be green, which signifies no restriction is in place for that block and a train may proceed through the block at maximum authorized speed. The blocks are traditionally sized such that a train may be brought to a stop within one block under worst case conditions (e.g., maximum speed, maximum train weight, etc.), thereby ensuring that a train that had been proceeding at full speed upon entering a yellow block can be brought to a stop before entering a next block if the next block is red.

It will be recognized by those of skill in the art that other, more complex signaling systems are known. For example, in the aforementioned CTC system, there are several intermediate signals (signals other than red or stop on the one hand and green or proceed without restriction on the other hand) rather than just the single yellow intermediate signal. Also, while some systems use fixed blocks (e.g., blocks whose boundaries are predetermined and static and are usually associated with landmarks such as specific mileposts are junctions points), dynamic block systems are also known and within the scope of the invention. Because of its simplicity, the ABS system discussed above will be used to illustrate the invention; however, it should be recognized that the invention is not so limited and can be used with a wide variety of signaling systems and techniques including but not limited to those discussed above.

In the present invention, the wayside signals 32, 42, 52 have the ability to transmit messages including the signal information and, preferably, an identification number to the train in addition to or in place of the colored lights discussed above. Preferably these signals 32, 42, 52 transmit such messages in response to interrogation signals, but the invention is not so limited. In other embodiments of the invention, the signals are equipped to detect the presence of a train an transmit a signal message automatically. In other embodiments, a message is broadcast repeatedly regardless of whether a train is present. In yet other embodiments, a central authority monitors the locations of trains in the system and instructs the switches 32, 42, 52 to transmit a message as the train approaches.

Figure 2:
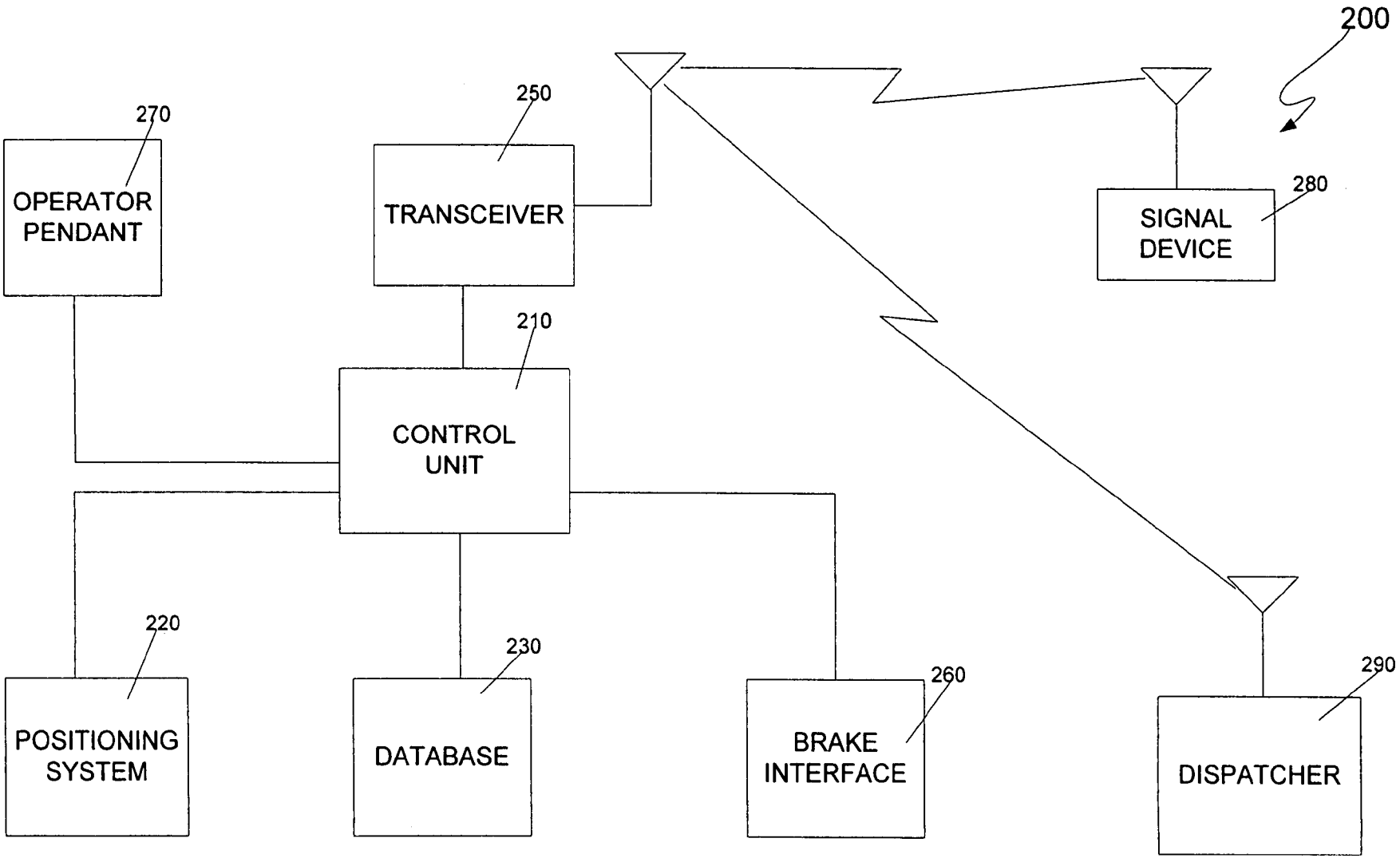
FIG. 2 is a logical block diagram of a train control system according to one embodiment of the invention.

FIG. 2 is a logical block diagram of a train control system 100 according to an embodiment of the present invention. The system 100 includes a control module 110, which typically, but not necessarily, includes a microprocessor. The control module 110 is responsible for controlling the components of the system.

The system 100 preferably includes a positioning system 120 connected to the control module 110. The positioning system supplies the position (and, in some cases, the speed) of the train to the control module 110. The positioning system 120 can be of any type, including a global positioning system (GPS), a differential GPS, an inertial navigation system (INS), or a Loran system. Such positioning systems are well known in the art and will not be discussed in further detail herein. (As used herein, the term "positioning system" refers to the portion of a positioning system that is commonly located on a mobile vehicle, which may or may not comprise the entire system. Thus, for example, in connection with a global positioning system, the term "positioning system" as used herein refers to a GPS receiver and does not include the satellites that transmit information to the GPS receiver.)

A database 130 is also connected to the control module 110. The database 130 preferably comprises a non-volatile memory such as a hard disk, flash memory, CD-ROM or other storage device, on which data is stored. Other types of memory, including volatile memory, may also be used. The data stored in the database preferably includes boundaries of all blocks in the system and identification numbers for all associated signal devices. The data preferably also includes map data including information concerning the direction and grade of the track in the railway. By using train position information obtained from the positioning system 120 and the map database 130, the control module 110 can determine its position relative to blocks in the system as well as the identification numbers of signal devices associated with those blocks.

The control module 110 communicates with a signal devices such as device 32 associated with block A 30 (not shown in FIG. 2) through transceiver 150. The transceiver 150 can be configured for any type of communication, including communicating through rails and wireless communication. In addition to communicating with signal devices, the transceiver 150 is also preferably capable of communicating with one or more dispatchers 190.

Also connected to the control module 110 is a brake interface 160. The brake interface 160 monitors the train brakes and allows the control module 110 to activate and control the brakes to stop or slow the train when necessary.

An operator pendant 170 is also connected to the control module 110. The pendant 170 may take the form of the operator display illustrated in co-pending U.S. application Ser. No. 10/186,426, entitled "Train Control System and Method of Controlling a Train or Trains" filed Jul. 2, 2002, the contents of which are hereby incorporated by reference herein. The pendant 170 may be used to display signals from the signal devices 32, 42, 52 to the operator and to provide other messages to the operator and receive certain inputs from the operator as will be discussed in further detail below.

Figure 3:
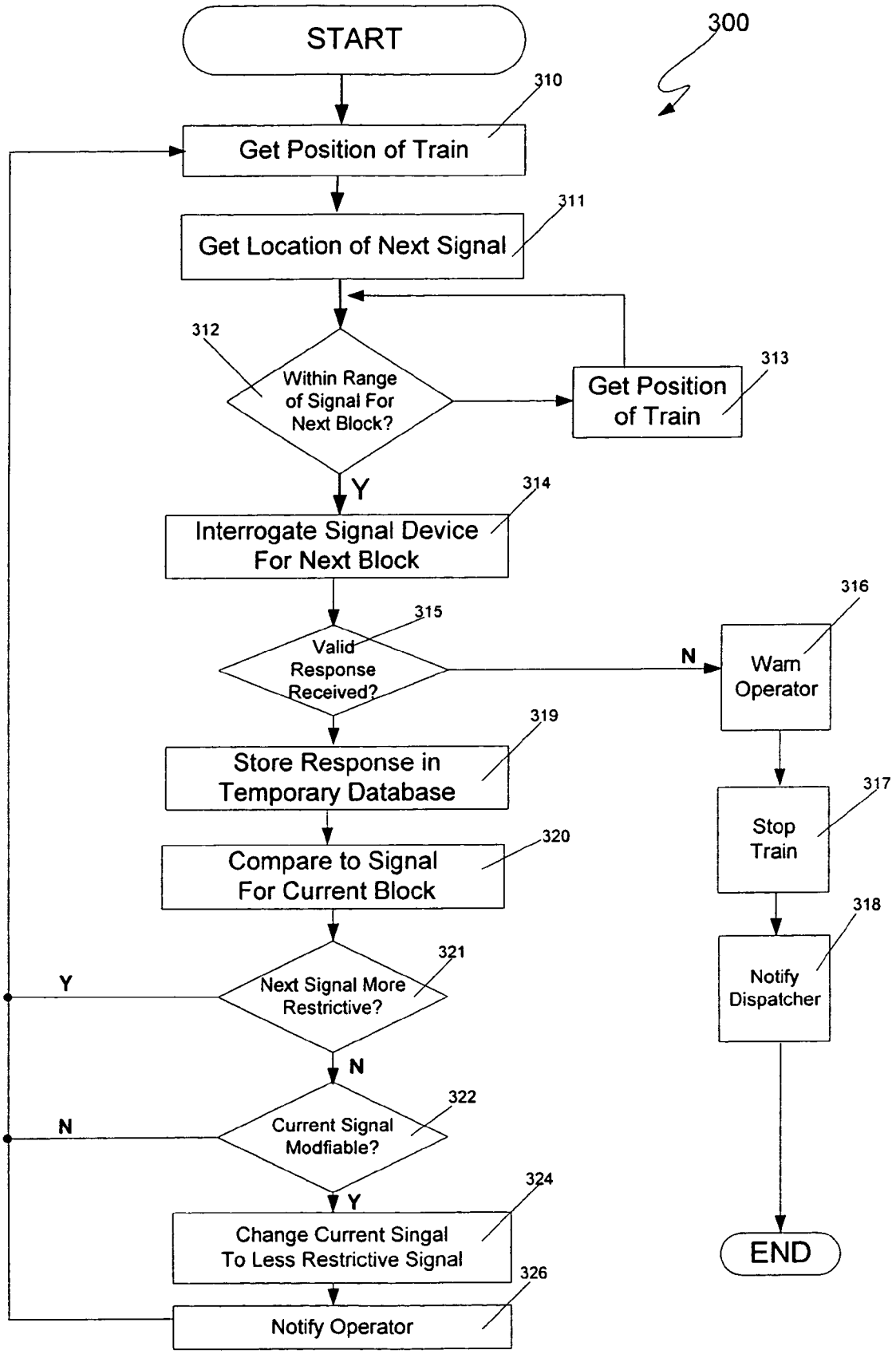
FIG. 3 a flow chart of an automatic fault reporting method performed by the system of FIG. 2.

FIG. 3 is a flowchart 300 illustrating operation of the control module 110 in connection with signal devices 32, 42, 52. It should be understood that the control module 110 performs steps in addition to those shown in FIG. 3 to ensure that the train complies with the signals it receives from the wayside signal devices 32, 42, 52. The control module 110 get the train's position from the positioning system 120 at step 310. Using the position reported by the positioning system, the control module then retrieves the location of the next signal device 32, 42, 52 from the database 130 at step 311. If the train is not within communication range of the next signal device 32, 42, 52 (e.g., the distance between the train's position and the location of the next signal device is less than a threshold distance) at step 312, the control module 110 gets an updated train position from the positioning system 120 at step 313 and repeats step 312 until the next signal device is within range at step 312. When the next signal device is within communications range at step 312, the control module 110 sends an interrogation message, preferably containing an identification number of the next signal device, at step 314. If no valid response (a valid response means a response that includes the correct identification number for the next signal device and does not indicate any errors) is received at step 315, the control module 110 warns the operator of the condition at step 316 and, unless the operator acts first, stops the train before reaching the next block boundary at step 317 by activating the train's brakes via the brake interface 160 and notifying the dispatcher 190 at step 318.

If a valid response is received at step 315, the response is stored in a temporary database at step 319 and is compared to a previously stored signal for the current block (that is, the signal before the train entered the block) at step 320. If the next signal is more restrictive at step 321, then steps 310 et seq. are repeated. If the signal for the next block is not more restrictive than the current signal at step 321, and the signal for the current block is modifiable at step 322, then the signal for the current block is changed to a less restrictive signal at step 324 and the operator is notified of the change at step 326.

It is important to note that not all signals are modifiable; that is, not all signals can be modified safely. For example, in some systems, a "red" or "stop" signal in a block before the train enters the block might be caused by another train in the block or might be caused by a broken rail in the block. In a system in which the signal device 32, 42, 52 does not provide information as to the reason for such a red signal, the red signal cannot be safely modified, or lifted, regardless of the signal in the next block. On the other hand, a yellow signal in a block is only caused by a red signal in a next block. Thus, if a train is in a block for which the signal was yellow before the train entered (of course, the signal in the block will change to red once the train enters the block) and the signal for the next block changes from red to either yellow or green (which signifies that either a train has left the next block or the broken rail or other problem has been corrected), the signal for the current block can be changed to a less restrictive signal. In more complex signaling systems, determining whether a signal is modifiable may be more complex.

In the example above, the yellow intermediate signal is changed to green, which is the least restrictive signal. In more complex systems with multiple intermediate signals, the signal may be changed to a less restrictive signal rather than to the least restrictive signal. As with the determination as to whether a signal is modifiable, the determination as to how to modify the signal may vary depending upon the exact nature and complexity of the signal system.

It should be noted that changing or modifying the signal, as discussed above with respect to step 324, means allowing the train to proceed as if the signal transmitted by the wayside signal device had been changed. This may be accomplished, for example, by modifying the value of the signal as reflected in the temporary database in the system 100. Causing a change in the signal actually being transmitted by the wayside signal device is not required for this step.

Once the signal for the current block has been modified at step 324, the operator is notified of the change at step 326. The notification is preferably accomplished using the operator pendant 170.

In some embodiments of the invention such as the embodiment discussed above, a wayside signal device is interrogated as the train approaches. However, the invention is not limited to such embodiments. In some other embodiments, wayside signal devices continuously or periodically transmit signal information regardless of whether a train is close enough to receive such information. In yet other embodiments, wayside signal devices detect when a train is approaching (using, e.g., track circuits or radar detectors) and transmit signal information at that time. In still other embodiments, a central authority tracks movement of trains and commands the wayside signal devices to transmit the signal information when a train is approaching. Other techniques for triggering the transmission of signal information from wayside signal devices are also possible and within the scope of the invention.

In the embodiments discussed above, the control module 110 is located on the train. It should also be noted that some or all of the functions performed by the control module 110 could be performed by a remotely located processing unit such as a processing unit located at a central dispatcher 190. In such embodiments, information from devices on the train (e.g., the brake interface 160) is communicated to the remotely located processing unit via the transceiver 150.

Obviously, numerous modifications and variations of the present invention are possible in light of the above teachings. It is therefore to be understood that within the scope of the appended claims, the invention may be practiced otherwise than as specifically described herein.

What is claimed is:

1. A system for controlling a train, the system comprising:

a control unit; and a receiver, the receiver being located on the train and being in communication with the control unit;

wherein the control unit is configured to perform the steps of receiving signal information for a next block via the receiver;

determining whether the signal information for a current block can be modified in a safe manner;

determining whether the signal information for the next block is less restrictive than the signal information for the current block; and changing the signal information for the current block to a less restrictive signal if the signal information for the current block can be modified in a safe manner and the signal information for the next block is not more restrictive than the signal information for the current block.

2. The system of claim 1, further comprising a display in communication with the control unit, wherein the control unit is further configured to perform the step of notifying an operator that the signal information for the current block has been changed by displaying a message on the display.

3. The system of claim 1, wherein the signal information is received from a wayside signal device.

4. The system of claim 3, further comprising a transmitter connected to the control unit, wherein the control unit is further configured to transmit an interrogation message to the wayside signal device via the transmitter.

5. The system of claim 4, further comprising a positioning system in communication with the control unit and a database including locations of wayside signal devices, the control unit being in communication with the database, wherein the control unit is further configured to perform the step of determining when to transmit the interrogation message to the wayside signal device based on information obtained from the database and the positioning system.

6. The system of claim 5, wherein the positioning system is a global positioning system.

7. The system of claim 5, wherein the interrogation message includes an identification number of the wayside signal device and the control unit is further configured to retrieve the identification number of the wayside signal device from the database.

8. The system of claim 1, wherein the signal information is changed to a less restrictive signal.

9. The system of claim 1, wherein the signal information is changed to a least restrictive signal.

10. A method for controlling a train comprising the steps of:

receiving signal information for a next block;

determining whether the signal information for the next block is less restrictive than the signal information for a current block;

determining whether the signal information for the current block can be modified in a safe manner; and allowing the train to proceed in the current block as if the signal information for the current block were less restrictive than actual signal information for the current block if the signal information for the current block can be modified in a safe manner and if the signal information for the next block is not more restrictive than the signal information for the current block.

11. The method of claim 10, further comprising the step of notifying an operator that the signal information for the current block has been changed.

12. The method of claim 10, wherein the signal information is received from a wayside signal device.

13. The method of claim 12, further comprising the step of transmitting an interrogation message to the wayside signal device.

14. The method of claim 13, further comprising the step of determining when to transmit the interrogation message to the wayside signal device based on location information for the wayside signal device obtained from a database and position information pertaining to the train from a positioning system.

15. The method of claim 14, wherein the positioning system is a global positioning system.

16. The method of claim 14, wherein the interrogation message includes an identification number of the wayside signal device.

17. The method of claim 10, wherein the signal information is changed to a less restrictive signal.

18. The method of claim 10, wherein the signal information is changed to a least restrictive signal.

* * * * *

UNITED STATES PATENT AND TRADEMARK OFFICE

CERTIFICATE OF CORRECTION

PATENT NO. : 7,092,800 B2
APPLICATION NO. : 11/032053
DATED : August 15, 2006
INVENTOR(S) : Mark Edward Kane et al.

It is certified that error appears in the above-identified patent and that said Letters Patent is hereby corrected as shown below:

On Title page item 63
Please add the priority information to the face of the above-referenced U.S. patent. The Domestic Priority data as claimed by applicant is clearly stated on the Official Filing Receipt as the following:

--This application is a CON of 10/392,850 3/21/2003 PAT 6,853,888--

Signed and Sealed this

Thirteenth Day of February, 2007

JON W. DUDAS
*Director of the United States Patent and Trademark Office*

UNITED STATES PATENT AND TRADEMARK OFFICE

CERTIFICATE OF CORRECTION

PATENT NO. : 7,092,800 B2
APPLICATION NO. : 11/032053
DATED : August 15, 2006
INVENTOR(S) : Mark Edward Kane et al.

It is certified that error appears in the above-identified patent and that said Letters Patent is hereby corrected as shown below:

Please add the priority information to the face of the above-referenced U.S. patent. The Domestic Priority data as claimed by applicant is clearly stated on the Official Filing Receipt as the following:

On Title Page item 63

--This application is a CON of 10/392,850 3/21/2003 PAT 6,853,888--

Signed and Sealed this

Sixth Day of March, 2007

JON W. DUDAS
*Director of the United States Patent and Trademark Office*